US008419968B2

(12) United States Patent
Carr et al.

(10) Patent No.: US 8,419,968 B2
(45) Date of Patent: Apr. 16, 2013

(54) LUBRICANTS FOR REFRIGERATION SYSTEMS

(75) Inventors: Dale Carr, Morristown, NJ (US); Jeffrey Hutter, Edison, NJ (US); Edward T. Hessell, Fairfield, CT (US); Richard Kelley, Princeton, NJ (US)

(73) Assignee: Chemtura Corporation, Middlebury, CT (US)

( * ) Notice: Subject to any disclaimer, the term of this patent is extended or adjusted under 35 U.S.C. 154(b) by 1 day.

(21) Appl. No.: 12/575,725

(22) Filed: Oct. 8, 2009

(65) Prior Publication Data

US 2010/0117022 A1 May 13, 2010

Related U.S. Application Data

(60) Provisional application No. 61/114,196, filed on Nov. 13, 2008.

(51) Int. Cl.
*C09K 5/04* (2006.01)

(52) U.S. Cl.
USPC ..... 252/68; 508/503

(58) Field of Classification Search ..... 252/68; 508/503
See application file for complete search history.

(56) References Cited

U.S. PATENT DOCUMENTS

| | | | | |
|---|---|---|---|---|
| 5,096,606 | A * | 3/1992 | Hagihara et al. | 252/68 |
| 5,665,686 | A * | 9/1997 | Schlosberg et al. | 508/485 |
| 5,750,750 | A | 5/1998 | Duncan et al. | |
| 5,853,609 | A | 12/1998 | Schnur et al. | |
| 6,153,118 | A * | 11/2000 | Hasegawa et al. | 252/68 |
| 6,221,272 | B1 | 4/2001 | Schnur et al. | |
| 6,267,906 | B1 * | 7/2001 | Schnur et al. | 252/68 |
| 6,582,621 | B1 * | 6/2003 | Sasaki et al. | 252/68 |
| 6,774,093 | B2 | 8/2004 | Carr et al. | |
| 2005/0049153 | A1 | 3/2005 | Zehler et al. | |

FOREIGN PATENT DOCUMENTS

| | | | |
|---|---|---|---|
| EP | 0 406 479 | A1 | 1/1991 |
| EP | 1985681 | A2 | 10/2008 |
| JP | 6 041559 | | 2/1994 |
| JP | 002574342 | | 10/2004 |
| WO | WO 98/46706 | | 10/1998 |

OTHER PUBLICATIONS

2008 ASHRAE Handbook, HVAC Systems and Equipment, Chapter 37.

* cited by examiner

*Primary Examiner* — John Hardee
(74) *Attorney, Agent, or Firm* — Joseph Suhadolnik; Chemtura Corp.; George Romanik

(57) ABSTRACT

A polyol ester suitable for use as a lubricant or a lubricant base stock has a kinematic viscosity at 40° C. less than or equal to 22 cSt and a viscosity index of greater than or equal to 140. The ester comprises a reaction product of (a) at least one polyhydric alcohol having at least 2 primary hydroxyl groups, (b) at least one monocarboxylic acid having 2 to 15 carbon atoms and (c) at least one polycarboxylic acid having 2 to 15 carbon atoms, wherein the number of acid groups derived from the polycarboxylic acid(s) is at least 25% of the total number of acid groups derived from the monocarboxylic and polycarboxylic acids.

35 Claims, No Drawings

LUBRICANTS FOR REFRIGERATION SYSTEMS

CROSS REFERENCE TO RELATED APPLICATIONS

This application claims the benefit of the filing date of U.S. Provisional Application No. 61/114,196 filed Nov. 13, 2008, the entire contents of which are incorporated herein by reference.

FIELD

This invention relates to polyol ester lubricants and their use in working fluids for refrigeration and air conditioning systems.

BACKGROUND

Polyol esters (POEs) are well known in the art as lubricants for displacement type refrigeration systems. Commonly used commercial POEs are derived from the reaction of a polyol (an alcohol containing 2 or more OH groups) with a monofunctional carboxylic acid. Such "simple" or "traditional" polyol esters are especially suited for use in systems utilizing hydrofluorocarbon refrigerants (HFCs) such as R-134a and related molecules because their polar nature provides improved miscibility with the refrigerant in comparison to other lubricants such as mineral oils, poly-alpha-olefins, or alkylated aromatics. One example of such a polyol ester lubricant is disclosed in U.S. Pat. No. 6,221,272.

The physical characteristics for simple polyol esters are primarily derived from the structure of the acid component. Because there are a wide variety of commercially available carboxylic acids, simple polyol esters can be designed with specific physical characteristics that are optimized for a particular refrigeration system application. But for simple polyol esters there are limits to the simultaneous optimization of all desired properties. For instance, the optimum lubricant would be one that has high miscibility with the refrigerant at low temperatures to ensure good transport of the lubricant in the evaporator and other low temperature components of the refrigeration cycle, but very low or poor solubility of the refrigerant in the lubricant at high temperature and pressure in the compressor to minimize viscosity reduction of the lubricant by refrigerant.

Viscosity reduction of the lubricant by refrigerant at high temperatures and pressures dramatically reduces the hydrodynamic lubricating ability of the lubricant. Also, the lubricity and load carrying ability of a polyol ester lubricant is improved by using longer chain linear acids rather than shorter chain and/or branched alkyl groups. But the exact opposite is true for miscibility with HFC or fluorocarbon refrigerants (i.e., branched and/or shorter chained acyl groups improve miscibility). So there is a careful balance required to optimize both the miscibility characteristics of the lubricant with refrigerant at low temperature and solubility of the refrigerant in the lubricant at high temperature and pressure, while also maintaining the best balance of lubricity and load carrying ability of the lubricant. In addition, the negative impact on lubricity and load carrying ability of the lubricant will become more pronounced as refrigeration system manufacturers move to lower viscosity lubricants to improve energy efficiency.

One mechanism for improving the lubricity and load carrying ability of a refrigeration lubricant is to include antiwear/extreme pressure additives. However, such additives may be undesirable since they can either precipitate out from the lubricant at low temperatures (as are encountered in the evaporator) or decompose to insoluble by-products at very high temperatures (as are experienced in the compressor). Such "drop out" of the additives from the lubricant can often lead to deposits on, or complete blockage of, the refrigerant system expansion device (thermal expansion valve, capillary, or needle valve) leading to a decrease in refrigeration performance or complete failure of the system. Additionally, for compressors with internal motors there is a potential for unfavorable reaction of the additives with the wire coatings used on the motors, leading to solubilization of the wire coatings in the system and eventual deposit on the expansion devise components.

Thus there is a need for a refrigeration lubricant that possesses high miscibility with the refrigerant over a wide temperature range of operation while also maintaining adequate lubricity and load carrying ability without the use of additives; provides protection against wear of refrigeration components and in addition improves the energy efficiency of the refrigeration system.

One potential way of addressing this need is to employ complex polyol esters, that is esters formed by the reaction of alcohols containing at least two —OH groups with polybasic carboxylic acids, normally in admixture with one or more monobasic carboxylic acids. Thus by virtue of their additional acid sites, polybasic acids offer the potential for tailoring the properties of the resultant esters to meet the varying requirements of an optimal lubricant.

For example, U.S. Pat. No. 5,096,606 discloses a refrigeration oil composition comprising (1) fluoroethane selected from the group consisting of 1,1,1,2-fluoroethane, pentafluoroethane, 1,1,1 trifluoroethane, and 1,1-difluoroethane and (2) an ester compound which is a reaction product obtained from (a) an aliphatic polyhydric alcohol having 1 to 6 primary hydroxyl groups, (b) a saturated aliphatic straight or branched monocarboxylic acid having 2 to 9 carbon atoms, or a derivative thereof and (c) a saturated aliphatic straight or branched dicarboxylic acid having 2 to 10 carbon atoms, or a derivative thereof, said ester compound having a kinematic viscosity at 100° C. of 1 to 100 cst.

In addition, U.S. Pat. No. 5,750,750 discloses a complex alcohol ester which comprises the reaction product of a mixture of the following:

a polyhydroxyl compound represented by the general formula: $R(OH)_n$ wherein R is any aliphatic or cyclo-aliphatic hydrocarbyl group and n is at least 2, provided that said hydrocarbyl group contains from about 2 to 20 carbon atoms;

a polybasic acid or an anhydride of a polybasic acid, provided that the ratio of equivalents of said polybasic acid to equivalents of alcohol from said polyhydroxyl compound is in the range between about 1.6:1 to 2:1; and a monohydric alcohol, provided that the ratio of equivalents of said monohydric alcohol to equivalents of said polybasic acid is in the range between about 0.84:1 to 1.2:1;

wherein the complex alcohol ester exhibits a pour point of less than or equal to −20° C., a viscosity in the range between about 100-700 cSt at 40° C. and having a polybasic acid ester concentration of less than or equal to 70 wt. %, based on the complex alcohol ester.

Further, U.S. Pat. No. 5,853,609 discloses a refrigerant working fluid which remains in a single phase between about −40° C. and about 71° C., said working fluid comprising a substantially chlorine-free fluoro-group-containing heat transfer fluid that comprises at least one of pentafluoroethane, 1,1-difluoroethane, 1,1,1-trifluoroethane and tetrafluoroethane and a composition of matter suitable for serving as a lubricant base stock, said composition being a liquid with a viscosity between about 22.5 and about 44 centistokes at 40° C. and consisting essentially of a mixture of polyol ester molecules in which at least 85% of the monobasic acid molecules in the acid mixture consist of molecules having five or nine carbon atoms each, at least about 92% of the alcohol moieties are selected from the group consisting of alcohol moieties derived from pentaerythritol (PE) and dipentaerythritol (DPE) and at least about 92% of the acyl groups are selected from the group consisting of the acyl groups of all the straight and branched chain monobasic and dibasic carboxylic acids with from four to twelve carbon atoms each, said alcohol moieties and acyl groups being further selected subject to the constraints that (a) a total of at least about 7% of the acyl groups in the mixture are acyl groups of i-$C_5$ acid; (b) the ratio of the percentage of acyl groups in the mixture that contain 8 or more carbon atoms and are unbranched to the percentage of acyl groups in the mixture that are both branched and contain not more than six carbon atoms is not greater than about 1.56; (c) the percentage of acyl groups in the mixture that contain at least nine carbon atoms, whether branched or not, is not greater than about 81; (d) not more than about 2% of the acyl groups in the ester mixture are part of acid molecules with more than two carboxyl groups each; (e) at least 60% of the monobasic acid molecules in the acid mixture consist of molecules having no more than ten carbon atoms each; and (f) a total of at least about 20% of the acid molecules in the mixture are one of the trimethylhexanoic acids; at least about 85% of the alcohol moieties in the esters are those of PE; and not more than about 7.5% of the acyl groups in the ester mixture are dibasic.

U.S. Published Patent Application No. 2005/0049153 discloses a lubricant composition comprising a complex polyol ester having: (a) a polyfunctional alcohol residue; and (b) a saturated or unsaturated dicarboxylic acid residue having from about 9 to about 22 carbon atoms. All the complex polyol esters exemplified have a viscosity in excess of 100 cSt at 40° C.

Thus, as will be seen from the above, most existing complex ester lubricants have a viscosity at 40° C. in excess of 100 cSt, whereas for many applications it is desirable to employ lower viscosity lubricants since these reduce the energy required to operate the refrigeration system. In addition, although there has been some limited work on low viscosity complex ester lubricants, these have in general required the use of very low levels of polybasic acid. Thus, with most polyol esters use of even low levels of polybasic acids increases the molecular weight significantly and leads to a rapid increase in viscosity.

According to the present invention, a complex polyol ester has now been developed that exhibits an advantageous combination of low kinematic viscosity and high viscosity index. The low viscosity provides the ester with good energy efficiency during start up, whereas the high V.I. ensures that the ester has acceptable viscosity at operating temperature to provide good lubricity and wear protection of refrigeration system components without the need for excessive amounts of antiwear/extreme pressure additives. In addition, the present low viscosity, high viscosity index complex polyol esters can be blended with higher viscosity traditional polyol esters to obtain intermediate viscosity grade lubricants with improved properties over simple polyol esters.

SUMMARY

In one aspect, the invention resides in a polyol ester suitable for use as a lubricant or a lubricant base stock, the ester having a kinematic viscosity at 40° C. less than or equal to 22 cSt and a viscosity index of greater than or equal to 140 and the ester comprising a reaction product of (a) at least one polyhydric alcohol having at least 2 primary hydroxyl groups, (b) at least one monocarboxylic acid having 2 to 15 carbon atoms and (c) at least one polycarboxylic acid having 2 to 15 carbon atoms, wherein the number of acid groups derived from the polycarboxylic acid(s) is at least 25%, and generally is 25 to 50%, of the total number of acid groups derived from the monocarboxylic and polycarboxylic acids.

Conveniently, said at least one polyhydric alcohol has the formula:

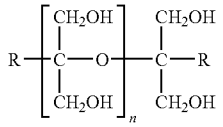

wherein each of R is independently selected from the group consisting of $CH_3$, $C_2H_5$ and $CH_2OH$; and n is a number from 0 to 10.

In one embodiment, said at least one polyhydric alcohol is a neopentylpolyol of the formula:

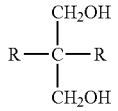

wherein each of R is independently selected from the group consisting of $CH_3$, $C_2H_5$ and $CH_2OH$.

Conveniently, said at least one polyhydric alcohol is selected from pentaerythritol, dipentaerythritol, tripentaerythritol, tetrapentaerythritol, trimethylolpropane, trimethylolethane, neopentyl glycol and mixtures thereof.

Conveniently, said at least one monocarboxylic acid has 5 to 11 carbon atoms, such as 6 to 10 carbon atoms, and typically is selected from acetic acid, propionic acid, butanoic acid, pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, 3-methylbutanoic acid, 2-methylbutanoic acid, 2-ethylhexanoic acid, 2,4-dimethylpentanoic acid, 3,3,5-trimethylhexanoic acid, benzoic acid and mixtures thereof.

Generally, (b) comprises at least one linear monocarboxylic acid, such as n-pentanoic acid, n-heptanoic acid, n-octanoic acid, n-nonanoic acid, n-decanoic acid, or a mixture thereof, particularly in admixture with at least one branched monocarboxylic acid, such as a branched C5 monocarboxylic acid, a branched C9 monocarboxylic acid or a mixture thereof. In one embodiment, the mixture of linear monocarboxylic and branched monocarboxylic acids comprises about 25 mole % to about 75 mole % linear monocarboxylic acid based on total moles of monocarboxylic acid.

Conveniently, said at least one polycarboxylic acid has 4 to 10 carbon atoms, such as 4 to 8 carbon atoms, and typically comprises adipic acid.

In a further aspect, the invention resides in a polyol ester suitable for use as a lubricant or a lubricant base stock, the ester having a kinematic viscosity at 40° C. less than or equal to 32 cSt and a viscosity index of greater than or equal to 140 and the ester comprising a reaction product of (a) at least one polyhydric alcohol having at least 2 primary hydroxyl groups, (b) at least one linear monocarboxylic acid having 2 to 15 carbon atoms (c) at least one branched monocarboxylic acid having 2 to 15 carbon atoms and (d) at least one polycarboxylic acid having 2 to 15 carbon atoms, wherein the number of acid groups derived from the polycarboxylic acid(s) is at least 25%, and generally is 25 to 50%, of the total number of acid groups derived from the monocarboxylic and polycarboxylic acids.

In yet a further aspect, the invention resides in a polyol ester suitable for use as a lubricant or a lubricant base stock, the ester having a kinematic viscosity at 40° C. less than or equal to 22 cSt and a viscosity index of greater than or equal to 140 and the ester comprising a reaction product of (a) at least one polyhydric alcohol selected from neopentylglycol, trimethylolpropane and mixtures thereof, (b) at least one monocarboxylic acid having 5 to 9 carbon atoms and (c) at least one polycarboxylic acid selected from succinic acid, glutaric acid, adipic acid and mixtures thereof, wherein the number of acid groups derived from the polycarboxylic acid(s) is at least 25%, and generally is 25 to 50%, of the total number of acid groups derived from the monocarboxylic and polycarboxylic acids.

In still yet a further aspect, the invention resides in a lubricant blend comprising a mixture of a first polyol ester as described herein and a further polyol ester having a different kinematic viscosity than said first polyol ester. Typically, said further polyol ester consists essentially of a reaction product of at least one polyhydric alcohol having at least 2 primary hydroxyl groups and at least one monocarboxylic acid. In one embodiment, said further polyol ester has a kinematic viscosity at 40° C. greater than or equal to 100 cSt.

In another aspect, the invention resides in a working fluid comprising a halogenated hydrocarbon refrigerant and the polyol ester described herein. Generally, the refrigerant is a hydrofluorocarbon, a fluorocarbon or a mixture thereof.

DETAILED DESCRIPTION OF THE EMBODIMENTS

As used herein, the term "acid value" of a polyol ester composition refers to the amount of unreacted acid in the composition and is reported as amount in mg of potassium hydroxide required to neutralize the unreacted acid in 1 gram of the composition. For polyol esters this value is typically <0.1 mg KOH/g. The value is measured by ASTM D 974.

As used herein, the term "hydroxyl value" of a polyol ester composition refers to the amount of unreacted alcohol in the composition and is reported as amount in mg of potassium hydroxide required to neutralize the unreacted alcohol in 1 gram of the composition. The value is measured by AOCS Method CD13-60.

Values for kinematic viscosity at 40° C. and 100° C. reported to herein are determined by ASTM Method D 445 and for viscosity index reported herein are determined according to ASTM Method D 2270.

Described herein is a polyol ester which is suitable for use as a lubricant or a lubricant base stock and which has a kinematic viscosity at 40° C. of less than or equal to 32 cSt, and generally less than or equal to 22 cSt, and a viscosity index of greater than or equal to 140. The ester comprises a reaction product of (a) at least one polyhydric alcohol having at least 2 primary hydroxyl groups, (b) at least one monocarboxylic acid having 2 to 15 carbon atoms and (c) at least one polycarboxylic acid having 2 to 15 carbon atoms, wherein the number of acid groups derived from the polycarboxylic acid(s) is at least 25% of the total number of acid groups derived from the monocarboxylic and polycarboxylic acids.

Polyhydric Alcohol

The at least one polyhydric alcohol employed to produce the present polyol ester has at least 2 primary hydroxyl groups and generally is an aliphatic polyhydric alcohol having the formula:

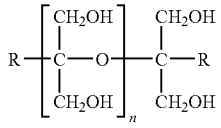

wherein each of R is independently selected from the group consisting of $CH_3$, $C_2H_5$ and $CH_2OH$; and n is a number from 0 to 10, such as 0 to 5.

In one embodiment, the at least one polyhydric alcohol is a neopentylpolyol of the formula:

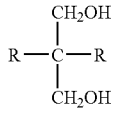

wherein each of R is independently selected from the group consisting of $CH_3$, $C_2H_5$ and $CH_2OH$.

Examples of suitable polyhydric alcohols include pentaerythritol, dipentaerythritol, tripentaerythritol, tetrapentaerythritol, trimethylolpropane, trimethylolethane, neopentyl glycol and mixtures thereof. Preferred polyhydric alcohols include dihydric alcohols, such as neopentyl glycol, since, with such difunctional materials, the polymer can only grow in a linear fashion which results in a smaller rate of viscosity increase with increasing incorporation of the polybasic acid.

Monocarboxylic Acid

The at least one monocarboxylic acid employed to produce the present complex polyol ester has from about 2 to about 15 carbon atoms and typically obeys the general formula:

$$R^1C(O)OH$$

wherein $R^1$ is a $C_1$ to $C_{12}$ alkyl, aryl, aralkyl or alkaryl group, such as a $C_4$ to $C_{10}$ alkyl group, for example $C_5$ to $C_9$ alkyl group. The alkyl chain $R^1$ may be branched or linear depending on the requirements for viscosity, viscosity index and degree of miscibility of the resulting lubricant with the refrigerant. In practice it is possible to use blends of different monobasic acids to achieve the optimum properties in the final lubricant.

Examples of suitable monocarboxylic acids include saturated, linear monocarboxylic acids, such as acetic acid, propionic acid, butanoic acid, pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid and mixtures thereof; saturated, branched monocarboxylic acids, such as the branched C5 acids (3-methylbutanoic acid and 2-methylbutanoic acid), the branched C7 acids (such as 2,4-dimethylpentanoic acid), the branched C8 acids (such as 2-ethylhexanoic acid), and the branched C9 acids (such as 3,3,5-trimethylhexanoic acid); as well as aromatic monocarboxylic acids, such as benzoic acid. Preferred linear monocarboxylic acids include n-pentanoic acid, n-heptanoic acid, n-octanoic acid, n-nonanoic acid, n-decanoic acid, and mixturea thereof, whereas preferred branched monocarboxylic acid include branched C5 monocarboxylic acids, branched C9 monocarboxylic acids and mixtures thereof.

In some embodiments, the acid precursor to the polyol ester is composed entirely of one or more linear monocarboxylic acids in combination with the polycarboxylic acid. However, other embodiments employ a mixture of linear and branched monocarboxylic acids in combination with the polycarboxylic acid. Generally, the amount of linear monocarboxylic acid in such a mixture is from about 25 mole % to about 100 mole %, preferably is from about 25 mole % to about 75 mole %, typically about 50 mole % based on total moles of monocarboxylic acid. Mixtures of linear and branched chain monocarboxylic acid are generally advantageous since they are frequently less expensive than the single isomer compositions. Mixtures of linear and branched chain monocarboxylic acid can be used herein to produce polyol esters having a kinematic viscosity at 40° C. up to 32 cSt.

Generally, the number of acid groups derived from the monocarboxylic acid present in the reaction mixture to produce the present polyol ester is between about 25% and about 75% of the total acid groups.

Polycarboxylic Acid

The at least one polycarboxylic acid employed to produce the present polyol ester has 2 to 15 carbon atoms, for example 4 to 10 carbon atoms, such as 4 to 8 carbon atoms, and typically has the general structure:

$$R^2(CO_2H)_m$$

where $R^2$ is a polyradical of valency m where m is a number from 2 to 4 and preferably is 2.

Non-limiting examples of polycarboxylic acids useful herein include saturated aliphatic dicarboxylic acids such as oxalic acid, malonic acid, succinic acid, glutaric acid, adipic acid, pimelic acid, suberic acid, azelaic acid, sebacic acid, undecanedioic acid, dodecanedioic acid, tridecanedioic acid, tetradecanedioic acid, pentadecanedioic acid methylmalonic acid, ethylmalonic acid, dimethylmalonic acid, methylsuccinic acid, 2,2-dimethylsuccinic acid, 2,3-dimethylsuccinic acid, 2-ethyl-2-methylsuccinic acid, 2-methylglutaric acid, 3-methylglutaric acid, 3,3-dimethylglutaric acid and 3-methyladipic acid; unsaturated aliphatic dicarboxylic acids such as maleic acid, fumaric acid, itaconic acid, citraconic acid and mesaconic acid; and aromatic dicarboxylic acids such as phthalic acid, isophthalic acid and terephthalic acid. Mixtures of such polycarboxylic acids can also be employed. The preferred polycarboxylic acid is adipic acid.

Generally, the amount of polycarboxylic acid employed in the reaction to produce the desired polyol ester is such that the number of acid groups derived from the polycarboxylic acid(s) is at least 25%, and generally is 25 to 75%, of the total number of acid groups derived from the monocarboxylic and polycarboxylic acids.

Production of the Polyol Ester

The present polyol ester can be produced in a single step or by a two stage reaction.

In the single step process, the total amounts of the polyol, polybasic acid and monobasic acid or acid mixture are charged to the reaction vessel at the beginning of the reaction, with the relative amount of polyol to acids in the charge being adjusted to provide a total hydroxyl:carboxylic molar equivalent ratio of about 0.9 to about 1.3, preferably about 0.95 to about 1.15 and more preferably about 1.0 to about 1.1.

In the two step process, the polyhydric alcohol (charged so as to provide 1.0 molar equivalents of hydroxyl) is charged to a reaction vessel in the first step along with an acid charge that includes the total amount of the desired polycarboxylic acid and a portion of the monocarboxylic acid so as to provide a total of about 0.8 to about 0.9 molar equivalents of acid, such as about 0.87 molar equivalents of acid. Using an undercharge of monocarboxylic acid in the first step helps to ensure that all of the dicarboxylic acid is esterified. The charge is then heated to the final reaction temperature and the first reaction step is continued until the acid value of the charge is less than 5, most preferably less than 1. Once the acid value target from the first step is attained, the remainder of the monocarboxylic acid(s) is charged to the reaction vessel to bring the combined molar equivalents of acid from both the dibasic and monobasic acids to a value of about 0.9 to about 1.3, preferably about 0.95 to about 1.15 and more preferably about 1.0 to about 1.1.

Whether conducted in one or two steps, the reaction is generally effected in a reaction vessel equipped with a mechanical stirrer, Dean-Stark trap and vertical water cooled condensor, thermocouple/heating mantle/temperature controller and nitrogen purge. Optionally, a catalyst, such as stannous oxalate is added to the reaction mixture. The charge is heated to a final reaction temperature of 220 to 260° C. under a slight purge of nitrogen during which the water of reaction is collected in the Dean-Stark trap and the acid is returned to the reactor. Any excess acid is finally stripped from the reaction mixture at reduced pressure to a hydroxyl value of less than 10 and an acid value <0.10

The resultant ester may be used without further purification or may be further purified using conventional techniques such as distillation, treatment with acid scavengers to remove trace acidity, treatment with moisture scavengers to remove moisture and/or filtration to improve clarity.

The polyol esters produced herein exhibit an advantageous combination of a low viscosity and a high viscosity index making them highly desirable for use in energy efficient refrigeration systems. However, for certain applications, higher viscosity is required and this can readily be achieved by blending the present low viscosity, high viscosity index complex polyol esters with higher viscosity lubricants, that is with a kinematic viscosity at 40° C. greater than or equal to 40 cSt, typically greater than or equal to 80 cSt. Such higher viscosity lubricants can be traditional polyol esters, that is esters consisting essentially of a reaction product of at least one polyhydric alcohol having at least 2 primary hydroxyl groups and at least one monocarboxylic acid; other complex esters, that is esters consisting essentially of a reaction product of at least one polyhydridic alcohol having at least 2 primary hydroxyl groups and a mixture of monocarboxylic acids and polycarboxylic acids; or a polyether polyol, such as those described in Carr, et al U.S. Pat. No. 6,774,093 which is incorporated by reference in its entirety. By blending the present low viscosity complex esters with higher viscosity esters, it is possible to obtain intermediate viscosity grade lubricants with improved properties over simple polyol esters of equivalent viscosity grade.

Use of the Polyesters

The present polyol esters are particularly intended for use as lubricants in working fluids for refrigeration and air conditioning systems, wherein the ester is combined with a heat transfer fluid, generally fluoro-containing organic compound such as a hydrofluorocarbon or fluorocarbon; a mixture of two or more hydrofluorocarbons or fluorocarbons; or any of the preceding in combination with a hydrocarbon. Non-limiting examples of suitable fluorocarbon and hydrofluorocarbon compounds include carbon tetrafluoride (R-14), difluoromethane (R-32), 1,1,1,2-tetrafluoroethane (R-134a), 1,1,2,2-tetrafluoroethane (R-134), pentafluoroethane (R-125), 1,1,1-trifluoroethane (R-143a) and tetrafluoropropene (R-1234yf). Non-limiting examples of mixtures of hydrofluorocarbons, fluorocarbons, and/or hydrocarbons include R-404A (a mixture of 1,1,1-trifluoroethane, 1,1,1,2-tetrafluoroethane and pentafluoroethane), R-410A (a mixture of 50 wt % difluoromethane and 50 wt % pentafluoroethane), R-410B (a mixture of 45 wt % difluoromethane and 55 wt % pentafluoroethane), R-417A (a mixture of 1,1,1,2-tetrafluoroethane, pentafluoroethane and n-butane), R-422D (a mixture of 1,1,1,2-tetrafluoroethane, pentafluoroethane and iso-butane), R-427A (a mixture of difluoromethane, pentafluoroethane, 1,1,1-trifluoroethane and 1,1,1,2-tetrafluoroethane) and R-507 (a mixture of pentafluoroethane and 1,1,1-trifluoroethane).

The present polyol esters can also be used with non-HFC refrigerants such as R-22 (chlorodifluoromethane), dimethylether, hydrocarbon refrigerants such as iso-butane, carbon dioxide and ammonia. A comprehensive list of other useful refrigerants can be found in European Published Patent Application EP 1985681 A, which is incorporated by reference in its entirety.

A working fluid containing the polyol ester described above as the base oil may further contain mineral oils and/or synthetic oils such as poly-α-olefins, alkylbenzenes, esters other than those described above, polyethers, polyvinyl ethers, perfluoropolyethers, phosphoric acid esters and/or mixtures thereof.

In addition, it is possible to add to the working fluid conventional lubricant additives, such as antioxidants, extreme-pressure additives, antiwear additives, friction reducing additives, defoaming agents, profoaming agents, metal deactivators, acid scavengers and the like.

Examples of the antioxidants that can be used include phenolic antioxidants such as 2,6-di-t-butyl-4-methylphenol and 4,4'-methylenebis(2,6-di-t-butylphenol); amine antioxidants such as p,p-dioctylphenylamine, monooctyldiphenylamine, phenothiazine, 3,7-dioctylphenothiazine, phenyl-1-naphthylamine, phenyl-2-naphthylamine, alkylphenyl-1-naphthylamine, and alkylphenyl-2-naphthylamine; sulfur-containing antioxidants such as alkyl disulfide, thiodipropionic acid esters and benzothiazole; and zinc dialkyl dithiophosphate and zinc diaryl dithiophosphate.

Examples of the extreme-pressure additives, antiwear additives, friction reducing additives that can be used include zinc compounds such as zinc dialkyl dithiophosphate and zinc diaryl dithiophosphate; sulfur compounds such as thiodipropinoic acid esters, dialkyl sulfide, dibenzyl sulfide, dialkyl polysulfide, alkylmercaptan, dibenzothiophene and 2,2'-dithiobis(benzothiazole); sulfur/nitrogen ashless antiwear additives such as dialkyldimercaptothiadiazoles and methylenebis(N,N-dialkyldithiocarbamates); phosphorus compounds such as triaryl phosphates such as tricresyl phosphate and trialkyl phosphates; dialkyl or diaryl phosphates; trialkyl or triaryl phosphites; amine salts of alkyl and dialkylphosphoric acid esters such as the dodecylamine salt of dimethylphosphoric acid ester; dialkyl or diaryl phosphites; monoalkyl or monoaryl phosphites; fluorine compounds such as perfluoroalkyl polyethers, trifluorochloroethylene polymers and graphite fluoride; silicon compounds such as a fatty acid-modified silicone; molybdenum disulfide, graphite, and the like. Examples of organic friction modifiers include long chain fatty amines and glycerol esters.

Examples of the defoaming and profoaming agents that can be used include silicone oils such as dimethylpolysiloxane and organosilicates such as diethyl silicate. Examples of the metal deactivators that can be used include benzotriazole, tolyltriazole, alizarin, quinizarin and mercaptobenzothiazole. Furthermore, epoxy compounds such as phenyl glycidyl ethers, alkyl glycidyl ethers, alkylglycidyl esters, epoxystearic acid esters and epoxidized vegetable oil, organotin compounds and boron compounds may be added as acid scavengers or stabilizers.

Examples of moisture scavengers include trialkylorthoformates such as trimethylorthoformate and triethylorthoformate, ketals such as 1,3-dioxacyclopentane, and amino ketals such as 2,2-dialkyloxazolidines.

The working fluids comprising the esters of the invention and a refrigerant can be used in a wide variety of refrigeration and heat energy transfer applications. Examples include all ranges of air conditioning from small window air conditioners, centralized home air conditioning units to light industrial air conditioners and large industrial units for factories, office buildings, apartment buildings and warehouses. Refrigeration applications include small home appliances such as home refrigerators, freezers, water coolers and icemakers to large scale refrigerated warehouses and ice skating rinks. Also included in industrial applications would be cascade grocery store refrigeration and freezer systems. Heat energy transfer applications include heat pumps for house hold heating and hot water heaters. Transportation related applications include automotive and truck air conditioning, refrigerated semi-trailers as well as refrigerated marine and rail shipping containers.

Types of compressors useful for the above applications can be classified into two broad categories; positive displacement and dynamic compressors. Positive displacement compressors increase refrigerant vapor pressure by reducing the volume of the compression chamber through work applied to the compressor's mechanism. Positive displacement compressors include many styles of compressors currently in use, such as reciprocating, rotary (rolling piston, rotary vane, single screw, twin screw), and orbital (scroll or trochoidal). Dynamic compressors increase refrigerant vapor pressure by continuous transfer of kinetic energy from the rotating member to the vapor, followed by conversion of this energy into a pressure rise. Centrifugal compressors function based on these principles. Details of the design and function of these compressors for refrigeration applications can be found in the 2008 ASHRAE Handbook, HVAC systems and Equipment, Chapter 37; the contents of which are included in its entirety by reference.

The invention will now be more particularly described with reference to the following Examples.

In the Examples, pour point values were determined according to ASTM D 97 and flash point values were determined according to ASTM D 92.

EXAMPLE 1

Neopentylglycol (NPG) (0.5 moles; 1.0 molar equivalent of hydroxyl) was charged to a round bottom flask equipped with a mechanical stirrer, Dean-Stark trap and vertical water cooled condensor, thermocouple/heating mantle/temperature controller and nitrogen purge along with 0.634 moles of n-heptanoic acid, 0.185 moles of adipic acid and 0.2 grams tin oxalate catalyst. Thus, with regard to the acid components of the reaction mixture, 63% of acid groups were derived from heptanoic acid and 37% of acid groups were derived from adipic acid.

The charge was heated to a final reaction temperature of between about 227° C. and 232° C. The water of reaction was collected in the Dean-Stark trap while any distilled acids were returned to the reactor. Vacuum was applied as needed in order to maintain the reaction. When the hydroxyl value was reduced to a sufficiently low level (a maximum of 5.0 mg KOH/gm) the excess acid was removed by vacuum distillation. The residual acidity was neutralized with an acid scavenger. The resulting ester base stock was dried under nitrogen purge and filtered. The properties of the filtered base stock are summarized in Table 1, from which it will be seen that the ester base stock had a kinematic viscosity at 40° C. of 18 cSt with a viscosity index of 147.

EXAMPLE 2 TO 4

In these Examples the procedure as Example 1 was repeated but with part of the n-heptanoic acid being replaced by iso-pentanoic acid and with the molar ratio of acid groups derived from monobasic acid to those derived from polybasic acid being varied between 2.63:1 (Example 4) and 1.5:1 (Example 3), with a ratio of 2.57 for Example 2. As in Example 1, the amount of neopentyl glycol (NPG) was arranged to provide 1.0 molar equivalents of hydroxyl groups and the mixed charge of monobasic and dibasic acids was arranged to provide a total of 1.0 equivalents of acid groups. Again, the results are summarized in Table 1, from which it will be seen that the filtered ester base stock of Example 2 had a kinematic viscosity at 40° C. of 16 cSt with a viscosity index of 143, and the filtered ester base stock of Example 3 had a kinematic viscosity at 40° C. of 19 cSt with a viscosity index of 148. The filtered product of Example 4 had a kinematic viscosity at 40° C. of 17 cSt and a viscosity index of 151.

COMPARATIVE EXAMPLE 1

The process of Example 1 was repeated but with the acid mixture being composed of 66.7. mole % heptanoic acid and 33.3 mole % adipic acid, so that the molar ratio of acid groups derived from monobasic acid to those derived from polybasic acid was 1:1. Again the total charge contained 1.0 molar equivalents of hydroxyl groups from NPG and 1.1 equivalents of acid groups. The results are again summarized in Table 1, from which it will be seen that the filtered ester base stock had a kinematic viscosity at 40° C. of 32 cSt with a viscosity index of 155.

TABLE 1

| | Example 1 | Example 2 | Example 3 | Example 4 | Comp. Example 1 |
|---|---|---|---|---|---|
| Polyol | NPG | NPG | NPG | | NPG |
| Acid (moles) | | | | | |
| n-C5 | | | | | |
| iso-C5 | | 0.24 | 0.2 | 0.31 | |
| n-C7 | 0.63 | 0.48 | 0.4 | 0.31 | 0.5 |
| iso-C9 | | | | | |
| adipic acid | 0.185 | 0.14 | 0.2 | 0.19 | 0.25 |
| Physical Properties | | | | | |
| Viscosity @ 40° C., cSt | 18.1 | 15.84 | 19.11 | 17.1 | 32.27 |
| Viscosity @ 100° C., cSt | 4.25 | 3.86 | 4.41 | 4.11 | 6.38 |
| V.I. | 147 | 143 | 148 | 151 | 155 |
| Density at 60° C., lb/gal | 8.134 | 8.151 | 8.216 | 8.222 | |
| Acid Value | 0.02 | 0.09 | 0.03 | .03 | 0.09 |
| Hydroxyl Value | 5.5 | 5.5 | 8.1 | 3.8 | 6.5 |
| Miscibility in R-410A, ° C. | | | | | |
| 5 vol % oil | <−63 +59 | <−60 +55 | | <−60 +69 | <−63 +43 |
| 10 vol % oil | −63 +55 | <−60 +58 | | <−60 +61 | −62 +41 |
| 30 vol % oil | −56 +64 | <−60 +66 | | <−60 >+70 | −57 +50 |
| 60 vol % oil | <−63 >+70 | <−60 >+70 | | <−60 >+70 | <−63 >+70 |

EXAMPLE 5

The process of Example 2 was repeated but using sebacic acid as the polybasic acid and with the acid mixture being composed of 0.375 moles of iso-pentanoic acid, 0.375 moles heptanoic acid and 0.125 moles sebacic acid, so that the molar ratio of acid groups derived from monobasic acid to those derived from polybasic acid was 3:1. Again the total charge contained 1.0 molar equivalents of hydroxyl groups from NPG and 1.1 equivalents of acid groups. The results are again summarized in Table 2, from which it will be seen that the filtered ester base stock had a kinematic viscosity at 40° C. of 28 cSt with a viscosity index of 160. However, miscibility with R-410A refrigerant was less than optimal.

COMPARATIVE EXAMPLES 2 to 4

Comparative Examples 2 to 4 were prepared using the procedure of Example 1 using a charge of polyol that provides 1.0 molar equivalents of hydroxyl (0.5 moles for NPG, 0.33 moles for TMP and 0.25 moles for PE) and a mixed charge of monobasic and dibasic acids in the percentages shown in Table 2 to provide a total of 1.1 equivalents of acid. The results are shown in Table 2, which also includes data obtained for two commercially available polyol esters, labeled Comparative Examples 5 and 6.

From Table 2 it will be seen that, in Comparative Example 2, when trimethylolpropane (TMP) was used as the polyol along with the branched iso-pentanoic and iso-nonanoic acids, the resultant ester had a kinematic viscosity at 40° C. of 31 cSt but a viscosity index of only 112. In Comparative Example 3, using NPG as the polyol and an acid mixture comprising equimolar amounts of iso-pentanoic acid and heptanoic acid and a molar ratio of acid groups derived from monobasic acid to those derived from polybasic acid was 4:1, the resultant ester had a very low kinematic viscosity at 40° C. of 11 cSt but a viscosity index of only 134. In Comparative Example 4, using TMP as the polyol and an acid mixture comprising equimolar amounts of iso-pentanoic acid and heptanoic acid and a molar ratio of acid groups derived from monobasic acid to those derived from polybasic acid was 4.7:1, the resultant ester had a kinematic viscosity at 40° C. of 29 cSt but a viscosity index of only 137.

With the commercially available polyol esters of Comparative Examples 5 and 6, mixtures of only monobasic acids were used, either with pentaerithrytol (PE) alone or in admixture with dipentaerythritol (DiPE). Both gave esters with a kinematic viscosity at 40° C. of around 30 cSt and, although the addition of the DiPE in Comparative Example 5, yielded an increase in viscosity index, in practice there is a limit to the VI improvement that can be achieved in this way and also higher levels of produce esters with a viscosity >32 cSt.

EXAMPLES 6 TO 10

In these Examples, the low viscosity, high viscosity index esters produced herein were blended with different high viscosity esters to demonstrate the use of the present esters to achieve synthetic lubricants having a wide range of ISO grades. The results are summarized in Table 3.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

TABLE 2

| | Example 5 | Comp. Ex 2 | Comp. Ex 3 | Comp. Ex 4 | Comp. Ex 5 | Comp. Ex 6 |
|---|---|---|---|---|---|---|
| Polyol | NPG | TMP | NPG | TMP | PE:DiPE (7.5:1 molar) | PE |
| Acid, moles | | | | | | |
| n-C5 | | | | | 43.1 | |
| iso-C5 | 0.375 | 0.488 | 37.5 | 0.4125 | | 46.7 |
| n-C7 | 0.375 | | 37.5 | 0.4125 | 43.4 | 23.1 |
| iso-C9 | | 0.488 | | | 15.5 | 30.2 |
| adipic acid | | 0.048 | 0.125 | 0.0875 | | |
| sebacic acid | 0.125 | | | | | |
| Physical Properties | | | | | | |
| Viscosity @ 40° C., cSt | 28.2 | 31.2 | 10.7 | 29.1 | 30 | 32.4 |
| Viscosity @ 100° C., cSt | 5.9 | 5.50 | 2.95 | 5.66 | 5.5 | 5.7 |
| V.I. | 160 | 112 | 134 | 137 | 130 | 116 |
| Density at 60° C., lb/gal | 8.207 | 8.13 | 8.088 | 8.34 | 8.29 | 8.29 |
| Pour Point, ° F. (° C.) | | | | −81 (−63) | −70 (−57) | −65 (−54) |
| Flash Point, ° F. (° C.) | | | | 455 (235) | 495 (257) | 480 (249) |
| Acid Value | 0.01 | | | 0.01 | 0.05 | 0.05 |
| Hydroxyl Value | 5.2 | | | 3.2 | <3 | <3 |
| Miscibility in R-410A, ° C. | | | | | | |
| 5 vol % oil | −34 +35 | −61 +59 | <−60 >+70 | −45 +41 | −40 +58 | −55 +62 |
| 10 vol % oil | NM @ RT | −54 +57 | <−60 >+70 | −39 +35 | −25 +49 | −45 +60 |
| 30 vol % oil | −29 +40 | −51 +62 | <−60 >+70 | −40 +46 | −22 +50 | −38 +61 |
| 60 vol % oil | <−60 >+70 | <−65 >+70 | <−60 >+70 | <−60 >+70 | <−60 >+70 | <−60 >+70 |

TABLE 3

| | Example 5 | Example 6 | Example 7 | Example 8 | Example 9 | Example 10 |
|---|---|---|---|---|---|---|
| Ester of Example 1 | 63 | 68 | 74 | 84 | 52 | 74 |
| 100 cSt PE Polyol Ester | 37 | | | 16 | | |
| 220 cSt Polyol Ester | | 32 | | | | |
| 400 cSt DiPE Polyol Ester | | | 26 | | | 26 |
| 80 cSt PE Polyol Ester (n-C5/iso-C9) | | | | | 48 | |
| Physical Properties | | | | | | |
| Viscosity @ 40° C., cSt | 31.9 | 31.4 | 31.4 | 22 | 30.1 | 31.4 |
| Viscosity @ 100° C., cSt | 6.4 | 6.1 | 6.1 | 4.9 | 5.6 | 6.1 |
| V.I. | 158 | 148 | 145 | 153 | 128 | 145 |
| Miscibility in R-410A, ° C. | | | | | | |
| 5 vol % oil | Not misc. at rt | −57 to +57 | −46 to +52 | | | |
| 10 vol % oil | Not misc. at rt | −40 to +48 | −38 to +46 | | | |
| 30 vol % oil | Not misc. at rt | −39 to +51 | −39 to +51 | | | |
| 60 vol % oil | Misc. at rt | <−60 to >+70 | <−60 to >+70 | | | |

The invention claimed is:

1. A polyol ester suitable for use as a lubricant or a lubricant base stock, the ester having a kinematic viscosity at 40° C. less than or equal to 22 cSt and a viscosity index of greater than or equal to 140 and the ester comprising a reaction product of (a) at least one polyhydric alcohol having at least 2 primary hydroxyl groups selected from pentaerythritol, dipentaerythritol, tripentaerythritol, tetrapentaerythritol, trimethylolpropane, trimethylolethane, neopentyl glycol and mixtures thereof, (b) at least one monocarboxylic acid having 2 to 15 carbon atoms wherein from about 25 mole % to about 100 mole % of the at least one monocarboxylic acid, based on total moles of monocarboxylic acid, is one or more linear monocarboxylic acids, and (c) at least one polycarboxylic acid having 2 to 15 carbon atoms, wherein the number of acid groups derived from the polycarboxylic acid(s) is 25 to 50% of the total number of acid groups derived from the monocarboxylic and polycarboxylic acids.

2. The ester of claim 1, wherein said at least one polyhydric alcohol is selected from trimethylolpropane, neopentyl glycol and mixtures thereof.

3. The ester of claim 1, wherein said at least one polyhydric alcohol is neopentylglycol.

4. The ester of claim 1, wherein said at least one monocarboxylic acid has 5 to 11 carbon atoms.

5. The ester of claim 1, wherein said at least one monocarboxylic acid has 6 to 10 carbon atoms.

6. The ester of claim 1, wherein said at least one monocarboxylic acid is selected from butanoic acid, pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, 3- methylbutanoic acid, 2-methylbutanoic acid, 2-ethylhexanoic acid, 2,4-dimethylpentanoic acid, 3,3,5-trimethylhexanoic acid, benzoic acid and mixtures thereof.

7. The ester of claim 6, wherein said at least one monocarboxylic acid comprises a mixture of at least one linear monocarboxylic acid selected from pentanoic acid, hexanoic acid, heptanoic acid, octanoic acid, nonanoic acid, and decanoic acid and at least one branched monocarboxylic acid selected from 3-methylbutanoic acid, 2-methylbutanoic acid, 2-ethylhexanoic acid, 2,4-dimethylpentanoic acid, and 3,3,5-trimethylhexanoic acid.

8. The ester of claim 7, wherein said at least one linear monocarboxylic acid comprises n-heptanoic acid.

9. The ester of claim 7, wherein said mixture comprises about 25 mole % to about 75 mole % of said at least one linear monocarboxylic acid.

10. The ester of claim 6, wherein (b) comprises n-heptanoic acid.

11. The ester of claim 6, wherein said at least one polycarboxylic acid comprises adipic acid.

12. The ester of claim 1, wherein said at least one polycarboxylic acid has 4 to 10 carbon atoms.

13. The ester of claim 1, wherein said at least one polycarboxylic acid comprises adipic acid.

14. The ester of claim 1 and having a kinematic viscosity at 40° C. less than or equal to 20 cSt.

15. A lubricant blend comprising a mixture of the polyol ester of claim 1 and a further polyol ester having a different kinematic viscosity than said first mentioned polyol ester.

16. The blend of claim 15 wherein said further polyol ester consists essentially of a reaction product of at least one polyhydric alcohol having at least 2 primary hydroxyl groups and at least one monocarboxylic acid.

17. The blend of claim 15 wherein said further polyol ester has a kinematic viscosity at 40° C. greater than or equal to 40 cSt.

18. A working fluid comprising a halogenated hydrocarbon refrigerant and the polyol ester of claim 1.

19. The working fluid of claim 18 wherein the refrigerant is a hydrofluorocarbon, a fluorocarbon or a mixture thereof.

20. The ester of claim claim 1 comprising a reaction product of (a) neopentylglycol, (b) at least one monocarboxylic acid having 5 to 9 carbon atoms wherein from about 25 mole % to about 100 mole % of the at least one monocarboxylic acid, based on total moles of monocarboxylic acid, is one or more linear monocarboxylic acids, and (c) at least one polycarboxylic acid selected from succinic acid, glutaric acid, adipic acid and mixtures thereof, wherein the number of acid groups derived from the polycarboxylic acid(s) is 25% to 50 of the total number of acid groups derived from the monocarboxylic and polycarboxylic acids.

21. The ester of claim 20, wherein said at least one polycarboxylic acid comprises adipic acid.

22. A lubricant blend comprising a mixture of the polyol ester of claim 20 and a further polyol ester having a different kinematic viscosity than said first mentioned polyol ester.

23. The blend of claim 22 wherein said further polyol ester consists essentially of a reaction product of at least one polyhydric alcohol having at least 2 primary hydroxyl groups and at least one monocarboxylic acid.

24. The blend of claim 22 wherein said further polyol ester has a kinematic viscosity at 40° C. greater than or equal to 40 cSt.

25. A working fluid comprising a halogenated hydrocarbon refrigerant and the polyol ester of claim 20.

26. The working fluid of claim 25 wherein the refrigerant is a hydrofluorocarbon, a fluorocarbon or a mixture thereof.

27. The ester of claim 20, wherein said at least one monocarboxylic acid is selected from pentanoic acid, hexanoic acid, heptanoic acid, octanoic acid, nonanoic acid, 3-methylbutanoic acid, 2-methylbutanoic acid, 2-ethylhexanoic acid, 2,4-dimethylpentanoic acid, 3,3,5-trimethylhexanoic acid, and mixtures thereof.

28. The ester of claim 27, wherein said at least one monocarboxylic acid comprises n-heptanoic acid and 2-methylbutanoic acid and/or 3,3,5-trimethylhexanoic wherein of about 25 mole% to about 75 mole% of said at least one monocarboxylic acid is n-heptanoic acid.

29. The ester of claim 28, wherein wherein said at least one polycarboxylic acid comprises adipic acid.

30. A working fluid comprising a halogenated hydrocarbon refrigerant and the polyol ester of claim 28.

31. The working fluid of claim 30 wherein the refrigerant is a hydrofluorocarbon, a fluorocarbon or a mixture thereof.

32. The ester of claim 27, wherein said at least one monocarboxylic acid consistis of n-heptanoic acid.

33. The ester of claim 32, wherein wherein said at least one polycarboxylic acid comprises adipic acid.

34. A working fluid comprising a halogenated hydrocarbon refrigerant and the polyol ester of claim 32.

35. The working fluid of claim 34 wherein the refrigerant is a hydrofluorocarbon, a fluorocarbon or a mixture thereof.

* * * * *